United States Patent [19]

Doyle et al.

[11] 4,106,629

[45] Aug. 15, 1978

[54] CAN DISPLAY HOLDER

[76] Inventors: Michael A. Doyle, 6917 Williams Dr., Perrysburg, Ohio 43551; Paul E. Ekey, 115 Homestead Dr., Rossford, Ohio 43460

[21] Appl. No.: 781,534

[22] Filed: Mar. 28, 1977

[51] Int. Cl.[2] ..... A47F 5/00

[52] U.S. Cl. ..... 211/71; 248/220.4; 248/311.1 R

[58] Field of Search ..... 211/71, 75, 88, 87, 211/89; 248/220.3, 220.4, 310, 311.1, 311.3, 221.1, 312, 314; 52/DIG. 9

[56] References Cited

U.S. PATENT DOCUMENTS

| | | | |
|---|---|---|---|
| 1,003,831 | 9/1911 | Hampton | 248/311.1 X |
| 1,021,037 | 3/1912 | Buffum | 248/310 |
| 1,060,885 | 5/1913 | Beck | 248/310 |
| 1,720,876 | 7/1929 | Anderson | 248/310 X |
| 3,036,717 | 5/1962 | Johnson | 211/88 |
| 3,751,082 | 8/1973 | Somerville | 52/DIG. 9 X |
| 3,921,948 | 11/1975 | Long | 248/220.4 |
| 3,994,465 | 11/1976 | Rudnitzky | 248/311.1 |
| 4,013,251 | 3/1977 | Cleveland | 248/310 X |
| 4,025,212 | 5/1977 | Block | 52/DIG. 9 |
| 4,029,281 | 6/1977 | Marshall | 248/220.3 |

*Primary Examiner*—Roy D. Frazier
*Assistant Examiner*—Robert W. Gibson, Jr.
*Attorney, Agent, or Firm*—Richard D. Emch

[57] ABSTRACT

A can display holder for use in displaying cans on a peg board having a plurality of vertically and horizontally spaced holes is disclosed. The can display holder has a base, a spaced pair of arms for engaging a respective paid of the peg board holes and a member extending downwardly from the base for resisting downward rotation.

13 Claims, 13 Drawing Figures

CAN DISPLAY HOLDER

SUMMARY OF THE INVENTION

Collections of items such as coins, stamps, books, paintings, etc., have always had a place throughout the history of mankind, such that by today the number of different items collected has reached infinite proportions. The present invention relates to the increasingly popular hobby of collecting cans, more specifically beverage cans. Beverage cans are collected for a number of reasons, for example, to display the wide variety of products and labels, to display as a decoration, to display as proof of large volumes of consumption, and even to save for refund. Heretofore, such dislays were often made on shelves, or by stacking the cans themselves.

The present invention is a can display holder for displaying cans on peg boards or similar structures. Because the cans may be displayed in vertical and horizontal juxtaposition immediately adjacent to the peg board, shelf and floor space are greatly saved on previous display methods. Also the present invention provides a display device which may be set up quickly and simply at display conventions of can collectors. Furthermore, the invention is useful in decorating walls, in that various cans may be displayed with a design pattern.

DETAILED DESCRIPTION

Figure 1:
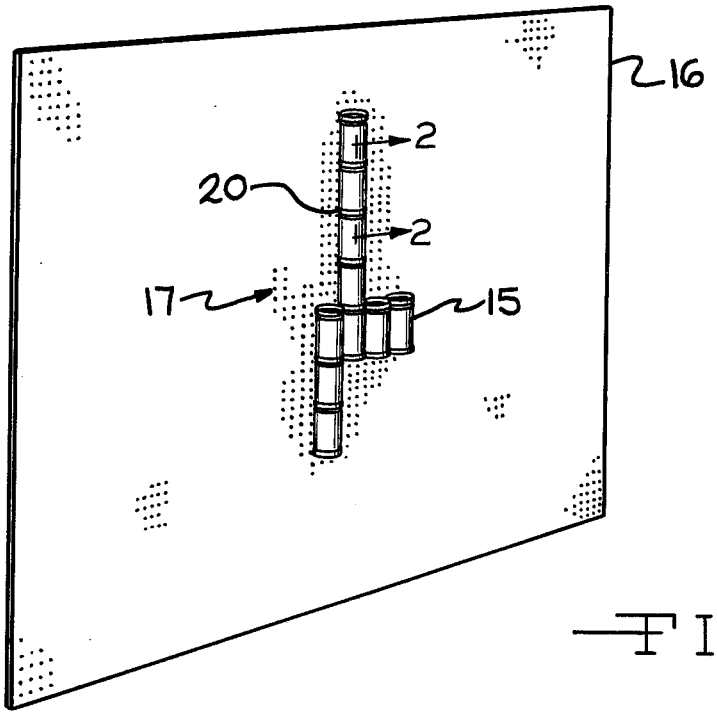
FIG. 1 is an overall perspective view illustrating a can display on pegboard using the can display holder of the present invention.

In FIG. 1, cans 15, for example beer cans, are displayed in vertical and horizontal juxtaposition on a pegboard 16 having a plurality of vertically and horizontally spaced holes 17, using one embodiment of a can display holder 20 to support and retain said cans 15.

Figure 2:
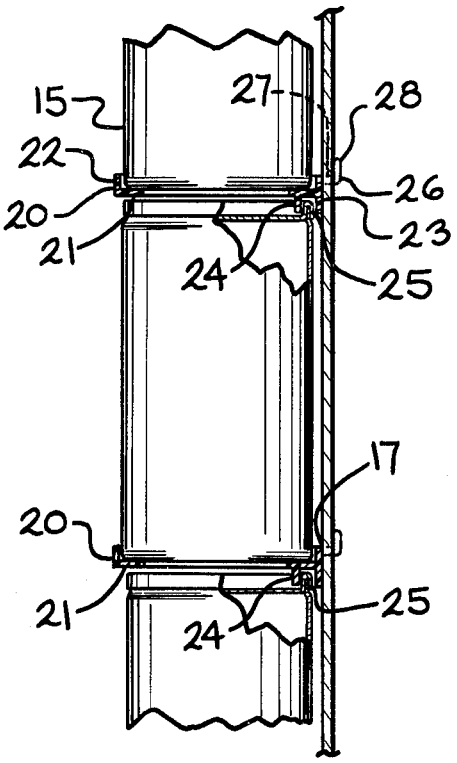
FIG. 2 is a fragmentary cross-sectional view taken along the line 2—2 of FIG. 1 illustrating one embodiment of the invention and shown on an enlarged scale.

FIG. 2 illustrates a cross-sectional view along the line 2—2 of FIG. 1. A can 15 is shown supported by a base 21 of the can display holder 20. The base 21 includes a rim 22 for retaining the can 15. A plate member 23 is integrally connected to and extends downwardly from the base 21, so that it abuts against the pegboard 16 to resist downward rotation of the display holder 20. Also, the base 21 includes a downwardly extending member 24 for holding an upper lip 25 of a can 15a positioned immediately below.

The display holder 20 includes a pair of arms 26 for engaging the holes 17 of the peg board 16. The arms 26 comprise horizontal sections 27 and upwardly extending sections 28. The upwardly extending sections 28 interlock the can display holder 20 with the peg board 16 and further resists downward rotation.

Figure 3:
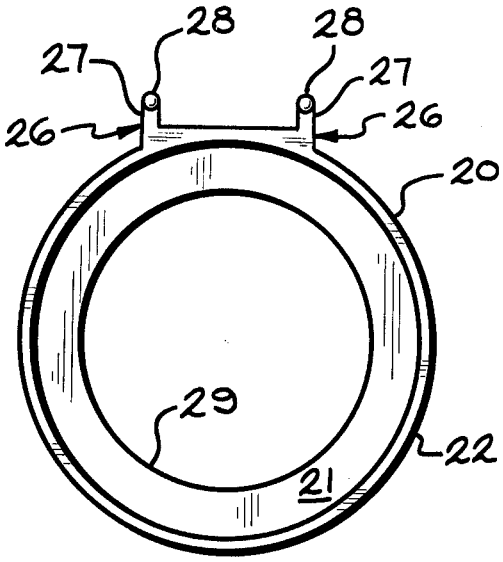
FIGS. 3,4,5, and 6 are top, bottom, front, and rear views, respectively, of the preferred embodiment shown in FIG. 2.
Figure 4:
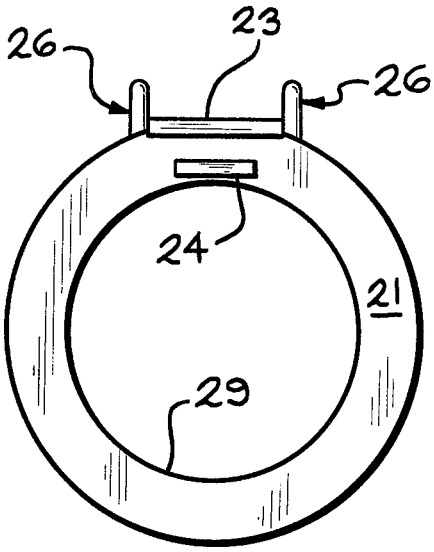
Figure 5:
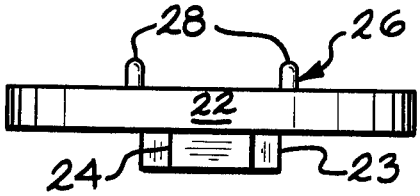
Figure 6:
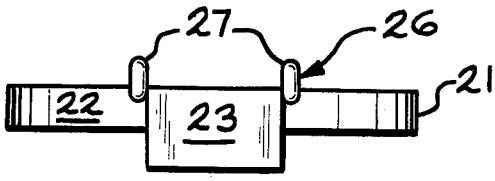

As shown in FIG. 3, the can display holder 20, includes a central hole or opening 29 in the center of the circular base 21.

While the display holder 20 may be constructed of many materials, the FIGS. 2–6 embodiment is preferably constructed of plastic.

Figure 7:
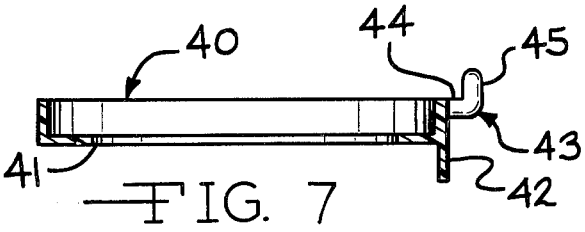
FIG. 7 is a side view of a second embodiment of a can display holder according to the invention.

FIG. 7 shows a simplified can display holder 40, including a base 41, an integrally connected downwardly extending plate member 42 for resisting downward rotation of the display holder 40 and an arm 43 for engaging the holes 17 of a pegboard 16. The arm consists of a horizontal section 44 and an upwardly extending section 45. The upwardly extending section 45 interlocks the can display holder 40 with the pegboard 16 and further resists downward rotation.

Figure 8:
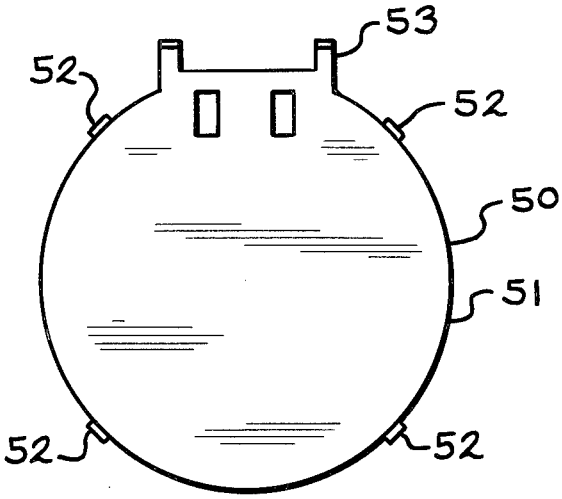
FIGS. 8,9, and 10 are top, front, and side views, respectively, of a third embodiment of a can display holder according to the invention.
Figure 9:
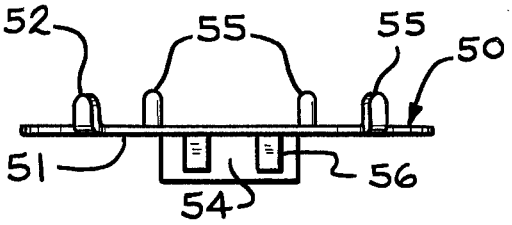
Figure 10:
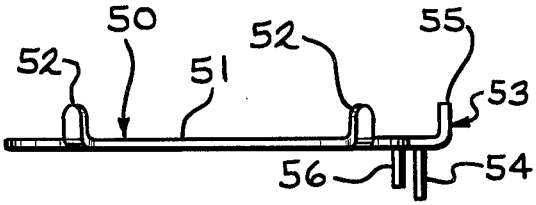

FIGS. 8, 9, and 10 illustrate the top, front, and side views, respectively, of another embodiment of a can display holder 50, completely manufacturable from a thin base 51 of any material, for example, steel, tin, or aluminum, capable of being die cut and stamped. The base 51 includes cut and stamped, upwardly extending members 52 for retaining a can 15. Arms 53 for engaging the holes 17 of the pegboard 16 are manufactured by die cutting and stamping the base 51 to form the downwardly extending plate member 54. The plate member 54 serves to resist downward rotation of the can display holder 50. The ends of the arms 53 are bent upward to form upwardly extending sections 55 for interlocking the can display holder 50 with the pegboard 16, and to further resist downward rotation of the can display holder 50. The base 51 is also cut and stamped downward to form downwardly extending members 56 for holding the upper lip 25 of a can 15 positioned immediately below the can display holder 50.

Figure 11:
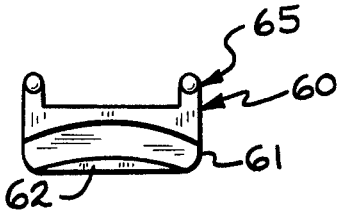
FIGS. 11,12, and 13 are top, front, and side views of a fourth embodiment of a can display holder according to the invention.
Figure 12:
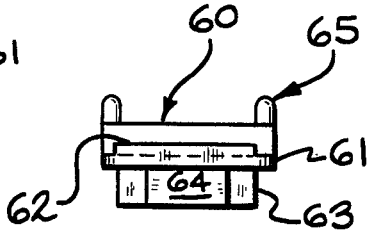
Figure 13:
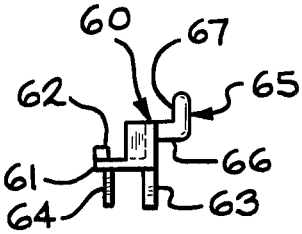

FIGS. 11, 12, and 13 illustrate the top, front, and side views, respectively, of another embodiment of a can display holder 60. This embodiment is for use with containers (not shown) which include both bottom lips and top lips. A base 61 on which a can is supportable, includes an upwardly extending member 62 for holding and retaining the lower lip of the can. An integrally connected downwardly extending plate member 63 resists downward rotation of the can display holder 60. The base 61 also includes downwardly extending member 64 for holding the upper lip of a can positioned immediately below the can display holder 60. The can display holder 60 includes an arm 65 for engaging the holes 17 of pegboard 16. The arm consists of a horizontal section 66 and an upwardly extending section 67. The upwardly extending section 67 interlocks the can display holder 60 with the pegboard 16 and further resists downward rotation of the can display holder 60.

While several embodiments of the invention have been described in detail for the purpose of illustration, it is not to be construed as limited thereby but is intended to cover all changes and modifications within the scope and spirit thereof.

We claim:

1. A can display holder for use in displaying cans on a pegboard or the like having a plurality of vertically and horizontally spaced holes, each of such cans having an upper lip, said can display holder comprising a base for supporting a can, means extending upwardly from said base for retaining a can on said base, arms extending from said base for engaging respective holes on such pegboard, means extending downwardly from said base for resisting downward rotation of the base, said resisting means including at least one rotation resisting member integrally mounted on said base and extending downwardly from said base for abutting such pegboard, and means extending downwardly for holding the lip of a can positioned immediately below said can display holder whereby said cans are displayed in vertical juxtaposition on said pegboard, said holding means comprising at least one holding member extending downwardly from said base spaced from and adjacent said resisting member wherein said holding member engages the interior surface of the upper lip of a can positioned immediately below said can display holder to prevent rotation of such can.

2. A can display holder, according to claim 1, wherein said base is circular and defines a central opening therethrough.

3. A can display holder, according to claim 1, wherein said retaining means comprises a rim.

4. A can display holder, according to claim 1, wherein said retaining means comprises at least two retaining members for fencing in a can supported on said base.

5. A can display holder, according to claim 1, wherein said base defines a segment of a circle less than 180°.

6. A can display holder, according to claim 1, wherein said arms include upwardly extending outer ends.

7. A can display holder, according to claim 1, wherein said downward rotation resisting means comprises a plate member integrally mounted on said base for abutting against said peg board.

8. A can display holder for use in displaying cans on a pegboard or the like having a plurality of vertically and horizontally spaced holes, each of such cans having an upper lip, said can display holder comprising a base defined by at least a segment of a circle for supporting a can, rim defined by at least a segment of a circle extending upwardly from said base for retaining a can on said base, a pair of spaced arms extending from said base for engaging respective holes on such pegboard, a plate member extending downwardly from said base for resisting downward rotation of the base, and means extending downwardly for holding the lip of a can positioned immediately below said can display holder whereby said cans are displayed in vertical juxtaposition on said pegboard, said holding means comprising at least one holding member extending downwardly from said base spaced from and adjacent said plate member wherein said holding member engages the interior surface of the upper lip of a can positioned immediately below said can display holder to prevent rotation of such can.

9. A can display holder, according to claim 8, wherein said base defines a segment of a circle less than 180°.

10. A can display holder, according to claim 8, wherein said arms include upwardly extending outer ends.

11. A can display holder, according to claim 8, wherein said plate member is integrally mounted on said base for abutting against said pegboard.

12. A can display holder, according to claim 8, wherein said base and said rim are both circular.

13. A can display holder, according to claim 8 wherein said circular base defines a central opening therethrough.

* * * * *